US005188724A

United States Patent [19]

Heilman et al.

[11] Patent Number: 5,188,724

[45] Date of Patent: Feb. 23, 1993

[54] OLEFIN POLYMER POUR POINT DEPRESSANTS

[75] Inventors: William J. Heilman; Bruce E. Wilburn, both of Houston, Tex.

[73] Assignee: Pennzoil Products Company, Houston, Tex.

[21] Appl. No.: 651,698

[22] Filed: Feb. 6, 1991

[51] Int. Cl.[5] ..... C10G 71/00

[52] U.S. Cl. ..... 208/18; 585/10; 585/12

[58] Field of Search ..... 208/18; 585/10, 12

[56] References Cited

U.S. PATENT DOCUMENTS

| | | | |
|---|---|---|---|
| 2,655,479 | 1/1949 | Mundy et al. | 252/56 |
| 3,598,552 | 8/1971 | Cohen | 585/12 |
| 3,598,737 | 8/1971 | Van der Meij et al. | 252/56 R |
| 3,607,749 | 9/1971 | Forbes | 252/56 |
| 3,679,644 | 7/1972 | Van der Meij et al. | 260/86.1 E |
| 3,763,244 | 10/1973 | Shubkin | 208/18 |
| 3,790,483 | 2/1974 | Song et al. | 585/12 |
| 3,843,537 | 10/1974 | Duling et al. | 585/12 |
| 3,897,353 | 7/1975 | Morduchowitz et al. | 252/51.5 A |
| 3,926,579 | 12/1975 | Rossi et al. | 585/12 |
| 4,018,695 | 4/1977 | Heilman et al. | 585/10 |
| 4,073,738 | 2/1978 | Ladenberger et al. | 585/12 |
| 4,088,589 | 5/1978 | Rossi et al. | 252/56 R |
| 4,132,663 | 1/1979 | Heilman et al. | 585/12 |
| 4,203,854 | 5/1980 | Silverstein | 252/25 |
| 4,844,829 | 7/1989 | Wilburn et al. | 252/56 R |
| 4,956,111 | 9/1990 | Wilburn et al. | 252/56 R |

OTHER PUBLICATIONS

Gavlin et al, "Industrial and Engineering Chemistry", vol. 45, pp. 2327-2335, (1953).

Clevenger et al, "Society of Automotive Engineers", Publication No. 831716, (1983).

Stambaugh, "Society for Automotive Engineers", Publication No. 841388, (1984).

*Primary Examiner*—Margaret Medley

*Attorney, Agent, or Firm*—Lowe, Price, LeBlanc & Becker

[57] ABSTRACT

A pour point depressant for lubricating oils comprises an olefin copolymer which contains alkyl side chains having carbon atoms, wherein the average side chain length in the copolymer is 10.5 to 12.0.

7 Claims, No Drawings

OLEFIN POLYMER POUR POINT DEPRESSANTS

FIELD OF THE INVENTION

This invention relates to pour point depressants derived from alpha-olefin polymers for use in lubricating oils, and more particularly to a new and novel class of olefin copolymer pour point depressants which provide substantial advantages when used in lubricating oils.

BACKGROUND

Wax-bearing lubricating oils are known to set to a semi-plastic mass on cooling below the temperature of the crystallization point of the wax contained in the lubricating oil. This change is measured in terms of pour point which may be defined as the temperature at which the oil sample is no longer considered to flow when subjected to the standardized schedule of quiescent cooling prescribed by ASTM D97-47. This problem presents a substantial disadvantage in the use of lubricating oils by the petroleum industry.

The problem with lubricating oils which contain any amount of waxes is that the wax contained in the oil, which is a paraffinic oil, will crystallize when the oil is cooled, and networks of wax crystals will then form on further cooling which will prevent the oil from flowing. The point at which the oil stops flowing is defined as the pour point temperature. Dewaxing of an oil improves the pour point, but this is an expensive procedure. Usually, the procedure is to dewax an oil to a certain temperature and then add pour point depressants to improve the low temperature properties. However, at the lower temperature, the same amount of wax will still separate. The pour point depressants do not make the wax more soluble in oil; they function rather by disrupting or preventing the formation of the waxy network. As little as 0.2 wt. % of a good pour point depressant can lower the pour point of the paraffinic oil or lubricating composition by 30°-35° C.

The wax networks will also lead to an increase in oil viscosity. The increase in viscosity is generally temporary as a "normal" internal combustion engine can generate sufficient shear to disrupt the wax networks and allow the oil to flow. However, it should be emphasized that while the physical turning or cranking of the engine is usually unimpeded, the temporary disruption in the oil flow can lead to an increase in bearing wear.

Studies have indicated that the amount of wax needed to prevent flow or gel for an oil is quite small. Approximately 2% precipitated wax will gel middle distillates, and a similar amount is needed for lubricating oils.

Many different types of pour point depressants have been used in the prior art. Previously used pour point depressants are predominantly oligomers having molecular weights of 1,000 to 10,000, or polymers which have molecular weights greater than 10,000. The early point depressants were either alkylated aromatic polymers or comb polymers. Comb polymers characteristically have long alkyl chains attached to the backbone of the polymer, with the alkyl groups being of different carbon chain lengths.

The mechanism of action for pour point depressants has been the subject of much interest. Early indications were that alkylated aromatic compounds function as pour point depressants by coating the surface of the wax crystals and preventing further growth. More recently, however, it appears that the pour point depressants are either absorbed into the face of the wax crystal if the pour point depressant is an alkyl aromatic or co-crystallize with the wax crystal if it is comb polymer. Thus, crystal growth is not prohibited; it is simply directed or channeled along different routes. Light microscopy suggests that wax crystals are typically thin plates or blades, and when a pour point depressant is added to the system, those crystals are smaller and more branched, and thus the pour point depressant may disrupt or redirect crystal growth from different directions into a single direction, and bulkier crystals will be formed. These crystals then can form networks only at much lower temperatures which results in a lower pour point.

Reports on pour points studies may be found in the publication by Gavlin et al entitled "Pour Point Depression of Lubricating Oils", *Industrial and Engineering Chemistry*, Vol. 45, 1953, pages 2327 to 2335. Also of interest in background with respect to pour point depressants is the publication by Clevenger et al, entitled "Low Temperature Rheology of Multigrade Engine Oils—Formulary Effects", 1983 Society of Automotive Engineers, Inc., Publication No. 831716; a publication by Henderson et al entitled "New Mini-Rotary Viscometer Temperature Profiles that Predict Engine Oil Pumpability", Society of Automotive Engineers, Inc. 1985, Document No. 850443; a publication by Lorensen, "Symposium on Polymers in Lubricating Oil Presented Before the Division of Petroleum Chemistry, American Chemical Society, Atlantic City Meeting, Sep. 9-14, 1962, Preprint, Vol. 7, No. 4; and a publication by R. L. Stambaugh entitled "Low Temperature Pumpability of Engine Oils", Society of Automotive Engineers, Document No. 841388, 1984.

As pointed out above, the most recent interest in pour point depressants is found in poly(methacrylate) polymers. Indeed, methacrylate/acrylate polymers appear to be the most popular class of pour point depressants now in use. There is available commercially a line of poly(methacrylate) pour point depressants from the Rohm and Haas Company under the tradename Acryloid. Also available are similar products from Texaco under a trade designation of TLA followed by a numerical suffix or TC followed by a numerical suffix.

There has also been substantial patent activity concerned with pour point depressants which comprise poly(methacrylate) compositions. Thus U.S. Pat. Nos. 3,679,644, 3,607,749 and 4,203,854 disclose polymethacrylates as viscosity index improvers.

Pat. No. 4,073,738 discloses the point depressant which comprises an alkyl acrylate or alkyl methacrylate wherein the alkyl group side chain can have from 8 to 30 carbon atoms and preferably from 8 to 22 carbon atoms U.S. Pat. No. 4,088,589 discloses a combination of pour point depressants of which one can be an oil soluble polymer of an alkyl acrylate or methacrylate which contains a side chain comprising 10 to 18 carbon atoms in the alkyl group. U.S. Pat. No. 2,655,479 is directed to polyester pour depressants and is particularly concerned with average side chain length of acrylate polymer pour depressants. U.S. Pat. 3,598,737 discloses lubricant compositions which contain copolymers of acrylate esters which are said to improve various characteristics including pour point. This patent states that the average number of carbon atoms should be at least 12.5 to 14.3. U.S. Pat. No. 3,897,353 discloses oil compositions comprising lubricating oil and a pour depressant which can be an alkylmethacrylate. These acrylates may be made from nitrogen-containing monomers wherein the alkyl portion of the ester or the side chain has from 12 to 18 carbon atoms and includes mixtures. U.S. Pat. No. 4,956,111 discloses poly(methacrylate) pour point depressants and compositions having an average side chain length of 12.6 to 13.8. These poly(methacrylates) are made from polymerizing three to five monomers wherein the esterified portion of the methacrylate has from 10 to 16 carbon atoms.

The present invention provides a pour point depressant based on olefin copolymer compositions which have advantageous properties in improving the low temperature properties of lubricating compositions.

SUMMARY OF THE INVENTION

It is accordingly one object of the present invention to provide a new and improved pour point depressant composition.

Another object of the invention is to provide a unique and advantageous olefin copolymer useful as a pour point depressant in lubricating oils.

A further object of the present invention is to provide a lubricating oil composition which contains a pour point depressant composition comprising an olefin copolymer having an average alkyl side chain of critical carbon chain length and produced by polymerization of a select group of monomers.

Other objects and advantages of the present invention will become apparent as the description thereof proceeds.

In satisfaction of the foregoing objects and advantages, there is provided by this invention a pour point depressant for lubricating oils comprising an olefin copolymer which contains alkyl side chains and wherein the average side chain length in the copolymer is 10.5 to 12.0.

Also provided for by the present invention is a hydrocarbon lubricating oil composition, said lubricating oil containing a sufficient amount of a pour point depressant to reduce the Federal Stable pour point to −35° C., the pour point depressant comprising an effective amount of an olefin copolymer produced by polymerization of certain alpha-olefin monomers and containing alkyl side chains wherein the average side chain length in the copolymer ranges from 10.5 to 12.0.

The present invention further provides a method of depressing the pour point of a lubricating oil composition which comprises adding to the lubricating oil composition an effective amount of a pour point depressant to reduce the pour point of the oil composition, the pour point depressant comprising an effective amount of an olefin copolymer which contains alkyl side chains, and wherein the average side chain length in the copolymer is 10.5 to 12.0.

DESCRIPTION OF PREFERRED EMBODIMENTS

This invention relates to a new class of pour point depressants and lubricating oils which contain such pour point depressants. The pour point depressants of the present invention comprise a selective group of olefin copolymers which are prepared by polymerization of certain alpha olefin mixtures. More specifically, the olefin copolymers of the present invention are terpolymers prepared by polymerization of decene ($C_{10}$), tetradecene ($C_{14}$) and hexadecene ($C_{16}$).

It has been found according to the present invention that for an olefin polymer to be effective as a pour point depressant in a lubricating oil, it must have an average side carbon chain length of 10.5 to 12.0 carbon atoms, and preferably 10.6 to 11.8 carbon atoms, and more preferably about 11.02 carbon atoms. Furthermore, it has been found that whether the formulation will pass or fail the low temperature limits for a lubricating oil formulation will depend, in large measure, on the number and kind of side chains present in the pour point depressant. When an olefin copolymer pour point depressant of this type is used, a lubricating oil of the 5W-30, 10W-30, 10W-40 and 15W-40 qualities can be produced which will pass the required low temperature tests for such oils.

A successful 5W-30 formulation is defined as one with a Federal Stable Pour of ≦−35° C., a viscosity of ≦3,500 cP at −25° C. in the Cold Cranking Simulator (CCS), and a MRV (minirotary viscometer) viscosity of ≦30,000 cP at −30° C. in both the 18 hour (D−3829) and TP−1 cooling cycles. A complete discussion of the low temperature rheology of multi-grade engine oils may be found in the publication by Clevenger et al, Document 831716, of the Society of Automotive Engineers, 1983, incorporated herein by reference. This publication sets forth the specifications for various grades of engine oils, particularly as may be seen in Table 1, page 2 of the publication.

In this application, the reference to average side carbon chain length refers to the length or number of the carbon atoms in the alkyl chain attached to the main chain or backbone of the polymer.

In this invention it has been discovered that both the composition or identity of the side chain and the average side chain length of an olefin copolymer pour point depressant are important in providing a good pour point depressant. The average side chain length in the range of 10.5 to 12.0 will depress the D-97 Federal Stable Pour point of a formulated oil to below −41° C. Alkyl side chain averages lower than 10.5 do not provide acceptable results, and polymers with side chain averages larger than 12.0 lower the pour point a lesser amount and are also unsatisfactory.

The correct average side chain carbon length of the olefin copolymer pour point depressants of this invention is obtained by using the correct mix of monomers in preparation of the polymer. The polymer is prepared by mixing and blending the monomers properly, and then subjecting to polymerization. The appropriate mix to obtain an average side chain in the range of 10.5 to 12.0 carbon atoms requires use of a mixture of three monomers of $C_{10}$, $C_{14}$ and $C_{16}$ hydrocarbons. The three monomers may be used in any ratio, but there must be present at least 10 wt% of each monomer. For example, a formulation of monomers which includes about 29 wt% decene, about 38 wt% tetradence, and about 37 wt% heraderene will produce a terpolymer which will have an average chain length in the range of 10.5 to 12.0. It is within the scope of the present invention, however, to select any combination of at least three alpha olefin monomers in the $C_{10}$ to $C_{16}$ range, with no monomer present in an amount of less than 10 wt. % to provide the final olefin copolymer with an average side chain length of 10.5 to 12.0. As will be apparent, the alkyl side chain units in the olefin copolymer may be randomly arranged so long as the averaged chain length is 10.5 to 12.0.

It should be noted that each carbon side chain on the polymer backbone will be two carbons less than each starting monomer because two of the carbons in the monomer polymerize into the main chain or backbone of the polymer. In the reaction, polymerization takes place across the double bond of the olefin monomer.

The method of calculation of the average side chain carbon length in this invention is the method disclosed in column 4, lines 31–49 of U.S. Pat. No. 3,814,690 where a method for calculating "mole equivalent average chain length" is discussed. This value is essentially the same as "average side chain length, Cav" in this patent application. The following formula is used:

$$Cav = \frac{(CN_1)(MP_1) + (CN_2)(MP_2) + (CN_3)(MP_3)}{MP_1 + MP_2 + MP_3}$$

when $CN_1$ is the number of chain carbons in the first chain, $CN_2$ is the number of chain carbons in the second chain, $CN_3$ is the number of chain carbons in the third chain, $MP_1$ is the mole percent of first component, $MP_2$ is the mole percent of the second component, $MP_3$ is the mole percent of the third component. Mole percent is equal to the mole fraction times 100%.

The monomers are known and the terpolymers may be produced by methods well known to the art. For example the terpolymers of the present invention are easily produced by Ziegler-Natta polymerization of alpha-olefin mixtures in the proportions discussed above.

As indicated above, the pour point depressant is used in a lubricating oil or engine oil in order to provide a formulation which will pass the low temperature tests required for such fluids, such as the Federal Stable Pour test. The pour point depressant is often used in combination with various other lube oil additives including viscosity index improvers, (VI), of which many different types are available. In the formulations described herein, two ethylene propylene viscosity index improvers, VII, were used. Both have dispersants grafted onto them to help keep the engine clean. VII A had a weight average molecular weight of 142,800 and a number average molecular weight of 55,800. VII B had a weight average molecular weight of 120,200 and the number average molecular weight of 51,500.

All formulations also contained a commercial detergent package, DI. All DI packages contained zinc dialkyldithiophosphates. All of the DI packages save for DI B contained a mixture of detergents and dispersants. DI A had a polyisobutylene (PIB) succinimide dispersant. A mixture of calcium and magnesium sulfonates served as the detergent package. DI B contained only calcium sulfonate detergents. DI A and B were used together. DI C had a PIB succinimide dispersant and a mixture of calcium and magnesium sulfonates served as the detergents. DI D used a PIB Mannich base as the dispersant and the detergents were a mixture of a calcium and magnesium sulfonate. DI E used a Mannich base as the dispersant while the detergents were a mixture of calcium and magnesium sulfonates. DI F used a mixture of calcium and magnesium sulfonates for detergents while the dispersant was a PIB succinimide. DI G used only calcium sulfonates as the detergent and a PIB succinimide as a dispersant. The DI packages are items of commerce with varied ingredients and methods of preparation which, in some cases, are proprietary to the manufacturers. Consequently, the above descriptions are merely illustrative of the types or classes of chemicals in the DI packages and should not be considered exhaustive or limiting.

The pour point improvers are normally used with a suitable lubricating fluid or engine oil. A preferred lubricating oil of this type is sold by Pennzoil Company under the tradename Atlas, and particularly Atlas 100N or Atlas 325N. Other base stocks such as, but not limited to, Ashland 100N or Exxon 100 LP are also suitable for use. The lubricating oil may be a 5W-30, 10W-30, 10W-40 or 15W-40 grade.

As a result of Applicants, research in this area, it has been discovered in a preferred embodiment that an effective pour point depressant which has an average side chain length of 10.5 to 12.0 will depress the Federal Stable Pour point of a fully formulated oil blended with Atlas 100N to below −41° C.

There is also a requirement that the molecular weight of the polymer of the invention have a lower limit of about 150,000 dalton and an upper limit in the range of 450,000 dalton. Thus the degree of polymerization is also important.

The amount of pour point depressant of this invention to be added to the lubricating oil will range from 0.001 to 1.0 wt.% and preferably range from about 0.01 to 0.50 wt. % when the pour point depressant is a concentrate.

The following examples are presented to illustrate the invention, but the invention is not to be considered as limited thereto. In the examples and throughout the specification, parts are by weight unless otherwise indicated.

EXAMPLE 1

Utilizing Ziegler-Natta polymerization, a Ziegler-Natta catalyst was prepared in a resin kettle as follows. 400 Milliliters of dried Heptane was heated to 90° C. in the resin kettle and purged with hydrogen for 30 minutes. 8.4 Milliliters of triethylaluminum in a 12 weight percent heptane solution was added to the resin kettle. 0.4 Grams of $TiC_{13}$ sealed in a wax capsule was added to the heptane catalyst solution.

An alpha-olefin mixture containing 330 gm of 25% decene, 38% dodecene, and 37% tetradecene was added dropwise to the resin kettle over a period of 30 minutes. The reaction was stirred 10 hours and maintained at a temperature of 95° C. The resulting polymer was isolated and dried.

Fifteen polymers were prepared according to the above process. The composition and molecular weight distributions are shown in Table 1, below. Chain av. refers to the nominal chain average obtained by the individual alpha olefin weights. Cavm refers to side chain average determined by GC on a megabore column. The compositions are from GC analysis. Molecular weight distributions were determined by GPC relative to polystyrene standards. The highest molecular weights were obtained when no hydrogen was used, entries 5 and 15. The molecular weight dropped to the 400,000 range when hydrogen was bubbled through the solution during the reaction, entries 6 and 14, and to the 100,000 and 200,000 range when hydrogen was used to purge the solution for approximately 30 minutes prior to the start of the reaction.

The concentrations in Table 1 are 40% by weight polymer. The oil polymer mixtures had to be heated at 60°–70° C. for two days to make a homogeneous solution.

TABLE 1

| OCP POUR POINT DEPRESSANTS - 40% CONCENTRATES | | | | | | | | | |
|---|---|---|---|---|---|---|---|---|---|
| CON. | CHAIN AV. | CAVM | $C_{10}$ | $C_{12}$ | $C_{14}$ | $C_{16}$ | $C_{18}$ | WT. AV. | NUM. AV. |
| A | | 9.77 | 49.60 | 0.82 | 41.11 | 8.47 | 0.00 | 217,500 | 27,900 |
| B | 10.03 | 10.09 | 24.26 | 37.98 | 35.94 | 1.82 | 0.00 | 227,900 | 27,600 |
| C | 11.01 | | 20.00 | 20.00 | 30.00 | 30.00 | 0.00 | 188,800 | 20,300 |
| D | 11.02 | 10.93 | 30.54 | 0.00 | 37.60 | 31.87 | 0.00 | 186,000 | 26,600 |
| E | 11.02 | | 29.10 | 0.00 | 37.80 | 33.10 | 0.00 | 820,000 | 83,200 |
| F | 11.02 | | 29.10 | 0.00 | 37.80 | 33.10 | 0.00 | 429,000 | 51,300 |
| G | 11.09 | 10.99 | 21.14 | 26.32 | 25.00 | 14.45 | 13.09 | 244,300 | 27,000 |
| H | 11.15 | 11.20 | 0.00 | 49.30 | 34.00 | 16.00 | 0.35 | 223,400 | 32,500 |
| I | 11.91 | 11.90 | 10.50 | 11.06 | 38.60 | 38.60 | 1.60 | 134,000 | 10,500 |
| J | 11.91 | 11.70 | 0.00 | 53.60 | 1.03 | 33.67 | 11.60 | 208,000 | 27,900 |
| K | 12.02 | | 15.30 | 15.40 | 19.45 | 26.30 | 23.60 | 144,900 | 17,500 |
| L | 12.04 | 11.84 | 16.25 | 0.74 | 39.19 | 43.82 | 0.00 | 133,800 | 19,700 |
| M | 12.04 | 12.03 | 0.00 | 25.26 | 39.60 | 35.13 | 0.00 | 219,000 | 23,800 |
| N | 12.36 | | 0.00 | 29.10 | 37.80 | 0.00 | 33.10 | 415,000 | 45,000 |
| O | 12.36 | | 0.00 | 29.10 | 37.80 | 0.00 | 33.10 | 850,000 | 70,000 |

EXAMPLE 2

Several olefin polymers made as in Example 1 were tested in a 5W-30 oil blended with Atlas 100N, VII A, DI A, and DI B. The results are given in Table 2 below. The olefin copolymers with a Cav around 10 produced formulations with 18 hour MRV or TP−1 problems, entries 1 and 2. These MRV problems are alleviated by increasing the Cav to 11 to 12, tests 3 to 8. Olefin copolymers composed of $C_{10}$-$C_{14}$-$C_{16}$ or $C_{12}$-$C_{14}$-$C_{18}$ produced blends with stable pours of $<-41°$ C., tests 4 to 7, with $C_{10}$-$C_{14}$-$C_{16}$ exhibiting an increase in the TP−1 viscosity as the Cav increases to 12, entries 5 and 6. The olefin copolymer composed of $C_{10}$-$C_{12}$-$C_{14}$-$C_{16}$ produced a blend with a unacceptable −21° C. stable pour, entry 3.

The $C_{12}$-$C_{14}$-$C_{16}$ polymer, in tests 7 and 8, also show a higher 18-hr. MRV or TP−1 when the side chain average is around 12.

range, the olefin copolymers composed of $C_{10}$-$C_{14}$-$C_{16}$ produced a $<-41°$ C. stable pour point at 0.15 or 0.321wt% treat rates, entries 2 and 3. The Scanning Brookfield viscosities are very good at 0.15 wt%, entry 2. No molecular weight effect was observed as the olefin copolymers with Mw of 400,000 or 186,000 produced formulations with identical stable pours of $<-41°$ C., entries 2 and 4, at the same treat rates.

The effect of chain composition was shown when olefin copolymers composed of four monomers, $C_{10}$-$C_{12}$-$C_{14}$-$C_{16}$, polymer C, Table 1, or five monomers, -$C_{10}$- $C_{12}$-$C_{14}$-$C_{16}$-$C_{18}$, polymers C and G, Table 1, were tested in the same class of formulations. The Federal Stable Pours are displayed in Table 3. Even though Olefin Copolymer C, $C_{10}$-$C_{12}$-$C_{14}$-$C_{16}$, and G, $C_{10}$-$C_{12}$-$C_{14}$-$C_{16}$-$C_{18}$, have the same side chain average as Olefin Copolymers C or D, $C_{10}$-$C_{14}$-$C_{16}$, the stable pours are −36° C. for the former, entries 5 and 7, and $<-41°$ C. for the latter, entries 2–4.

TABLE 2

| OCP PPDs AT 0.1 WT % IN 5W30s COMPOSED OF ATLAS 100N, VII A, DI A AND DI B | | | | | | | | | | | |
|---|---|---|---|---|---|---|---|---|---|---|---|
| Test # | PPD | CAV | CAVM | CHAINS | S.P. | MRV | Y.S. | TP-1 | Y.S. | Sc. Brookfield 40K | Sc. Brookfield 30K |
| 1) | B | 10.03 | 10.08 | $C_{10}$—$C_{12}$—$C_{14}$ | | 62,300 | 140 | 27,100 | 35 | | |
| 2) | A | 10.06 | 9.77 | $C_{10}$—$C_{14}$—$C_{16}$ | | 53,600 | 70 | 17,600 | 0 | | |
| 3) | C | 11.01 | | $C_{10}$—$C_{12}$—$C_{14}$—$C_{16}$ | −21 | 15,300 | 0 | 13,700 | 0 | | |
| 4) | F | 11.02 | | $C_{10}$—$C_{14}$—$C_{16}$ | $<-41$ | 18,600 | 0 | 15,150 | 0 | −34.00 | −32.40 |
| 5) | F | 11.02 | | $C_{10}$—$C_{14}$—$C_{16}$ | $<-41$ | 15,100 | 0 | 14,200 | 0 | | |
| 6) | L | 12.04 | 11.87 | $C_{10}$—$C_{14}$—$C_{16}$ | $<-41$ | 18,800 | 0 | 23,500 | 0 | | |
| 7) | N | 12.36 | | $C_{12}$—$C_{14}$—$C_{18}$ | $<-41$ | 20,600 | 0 | 18,500 | 0 | | |
| 8) | O | 12.36 | | $C_{12}$—$C_{14}$—$C_{18}$ | −36 | 24,400 | 0 | 16,200 | 0 | | |

EXAMPLE 3

Olefin copolymers composed of $C_{10}$-$C_{14}$-$C_{16}$ were tested in HVI Atlas 100N 5W-30s with DI C and VII A. The results of these tests are given in Table 3 below. While commercial pour point depressants will only lower the stable pour point to the −30° to −33° C.

The results clearly establish that even though copolymers may have the same side chain average, Cav, the identity or composition of these chains will play a large part in determining the effectiveness of the copolymer as a PPD, particularly with regard to the Stable pour of the formulation. While a rationale for this effect may not be readily apparent, nonetheless the effect is real.

TABLE 3

| OCP PPDs IN 5W30 HVI ATLAS 100N, ATLAS 325N, VII A AND DI C | | | | | | | | | | |
|---|---|---|---|---|---|---|---|---|---|---|
| Test # | PPD CHAINS | CHAIN AVG. | WT. % ATLAS 325N | PPD | WT. % PPD | S.P. | MRV | TP-1 | Sc. Brookfield 40K | Sc. Brookfield 30K |
| 1) | $C_{10}$—$C_{14}$—$C_{16}$ | 11.02 | 1.00 | F | 0.10 | −39 | | 15,800 | — | — |
| 2) | $C_{10}$—$C_{14}$—$C_{16}$ | 11.02 | 4.08 | F | 0.15 | $<-41$ | 13,900 | 15,100 | −36.2 | −34.6 |
| 3) | $C_{10}$—$C_{14}$—$C_{16}$ | 11.02 | 4.09 | F | 0.31 | $<-41$ | 15,100 | 14,700 | −33.5 | −32.1 |
| 4) | $C_{10}$—$C_{14}$—$C_{16}$ | 11.02 | 4.08 | D | 0.15 | $<-41$ | | 14,300 | −35.3 | −33.9 |

TABLE 3-continued

| Test # | PPD CHAINS | OCP PPDs IN 5W30 HVI ATLAS 100N, ATLAS 325N, VII A AND DI C: CHAIN AVG. | WT. % ATLAS 325N | PPD | WT. % PPD | S.P. | MRV | TP-1 | Sc. Brookfield 40K | Sc. Brookfield 30K |
|---|---|---|---|---|---|---|---|---|---|---|
| 5) | $C_{10}$—$C_{12}$—$C_{14}$—$C_{16}$—$C_{18}$ | 11.09 | 4.08 | G | 0.15 | −36 | 12,600 | 13,500 | — | — |
| 6) | $C_{10}$—$C_{12}$—$C_{14}$—$C_{16}$—$C_{18}$ | 12.02 | 4.08 | K | 0.15 | −33 | 13,900 | 16,100 | — | — |
| 7) | $C_{10}$—$C_{12}$—$C_{14}$—$C_{16}$ | 11.01 | | C | 0.15 | −36 | 14,100 | 14,700 | — | — |

EXAMPLE 4

In this example olefin copolymers with three chains were made according to the process of Example 1. The composition is shown in Table 4. They were tested in HVI Atlas 100N 5W-30 blends of VII A, Atlas 325N and DI C. Test data from these samples is given in Table 5 below.

As observed from Table 5, the $C_{10}$-$C_{14}$-$C_{16}$ olefin copolymer pour point depressant produces 5W-30 blends with good to excellent stable pours or −39 to <−40° C. at concentrations as low as 0.05 wt%, entry 4. Overall, there appeared to be no effect on the stable pour response when the Cav was decreased to 10.6 or raised to 12.0. The −30° C. TP−1 viscosity was shown to increase with increasing Cav; rising from the 15,000–16,000 cP range to the 20,000–22,000 cP range.

As observed, the other three component olefin copolymer pour point depressants, i.e., $C_{12}$-$C_{14}$-$C_{16}$ and $C_{12}$-$C_{16}$-$C_{18}$, entries 15–23 did not perform as well as the $C_{10}$-$C_{14}$-$C_{16}$ olefin copolymer pour point depressant.

TABLE 4

| Concentrate | CAV | OCP PPD COMPOSITION: Chains | $C_{10}$ | $C_{12}$ | $C_{14}$ | $C_{16}$ | $C_{18}$ | Wt. Av. | Num. Av. |
|---|---|---|---|---|---|---|---|---|---|
| 1) AA | 10.62 | $C_{10}$—$C_{14}$—$C_{16}$ | 33.04 | 0.00 | 40.36 | 26.57 | 0.00 | 430,700 | 39,900 |
| 2) AD | 11.02 | $C_{10}$—$C_{14}$—$C_{16}$ | 30.54 | 0.00 | 37.60 | 31.87 | 0.00 | 186,000 | 26,600 |
| 3) AF | 11.02 | $C_{10}$—$C_{14}$—$C_{16}$ | 29.10 | 0.00 | 37.80 | 33.10 | 0.00 | 429,000 | 51,300 |
| 4) AK | 11.82 | $C_{10}$—$C_{14}$—$C_{16}$ | 17.39 | 0.00 | 39.15 | 43.46 | 0.00 | 410,100 | 43,400 |
| 5) AM | 11.82 | $C_{10}$—$C_{14}$—$C_{16}$ | 17.39 | 0.00 | 39.15 | 43.46 | 0.00 | 410,100 | 43,400 |
| 6) AR | 11.72 | $C_{12}$—$C_{14}$—$C_{16}$ | 0.00 | 25.26 | 39.60 | 35.13 | 0.00 | 259,900 | 26,400 |
| 7) AT | 11.70 | $C_{12}$—$C_{14}$—$C_{18}$ | 0.00 | 42.05 | 39.58 | 0.00 | 18.36 | 219,000 | 28,500 |
| 8) AW | 12.36 | $C_{12}$—$C_{14}$—$C_{18}$ | 0.00 | 29.10 | 37.80 | 0.00 | 33.10 | 415,000 | 45,000 |
| 9) AZ | 12.36 | $C_{12}$—$C_{14}$—$C_{18}$ | 0.00 | 29.10 | 37.80 | 0.00 | 33.10 | 850,000 | 70,000 |
| 10) DDD | 11.91 | $C_{12}$—$C_{16}$—$C_{18}$ | 0.00 | 53.60 | 1.03 | 33.67 | 11.60 | 208,000 | 27,900 |

TABLE 5

RESULTS OF OCP PPDs WITH 3 CHAINS IN HVI ATLAS 100N 5W-30s BLENDS CONTAIN VII A, ATLAS 325N, AND DIC

| PPD | PPD CHAINS | CAV | WT. AV-ERAGE | WT. % | WT. PPD | KIN VIS | STABLE | MRV | YIELD STRESS | TPI | YIELD STRESS | 40K | 30K |
|---|---|---|---|---|---|---|---|---|---|---|---|---|---|
| 1) AA | $C_{10}$—$C_{14}$—$C_{16}$ | 10.62 | 430,700 | 30 | 0.15 | | −36 | | | 16,000 | 0 | | |
| 2) AA | $C_{10}$—$C_{14}$—$C_{16}$ | 10.62 | 430,700 | 30 | 0.15 | 10.524 | −39 | | | 15,800 | 0 | | |
| 3) AD | $C_{10}$—$C_{14}$—$C_{16}$ | 11.02 | 186,000 | 40 | 0.15 | | <−41 | 14,300 | 0 | 14,300 | 0 | −35.3 | −33.9 |
| 4) F | $C_{10}$—$C_{14}$—$C_{16}$ | 11.02 | 429,000 | 30 | 0.05 | | −39 | | | 16,300 | 0 | −33.4 | −31.4 |
| 5) F | $C_{10}$—$C_{14}$—$C_{16}$ | 11.02 | 429,000 | 40 | 0.10 | | −39 | | | 15,800 | 0 | | |
| 6) AF | $C_{10}$—$C_{14}$—$C_{16}$ | 11.02 | 429,000 | 30 | 0.10 | 10.454 | −39 | 14,500 | 0 | 13,900 | 0 | | |
| 7) AF | $C_{10}$—$C_{14}$—$C_{16}$ | 11.02 | 429,000 | 30 | 0.15 | 11.159 | <−41 | | 0 | 15,900 | 0 | −34.6 | −32.8 |
| 8) F | $C_{10}$—$C_{14}$—$C_{16}$ | 11.02 | 429,000 | 40 | 0.15 | | <−41 | 13,900 | 0 | 15,100 | 0 | −36.2 | −34.6 |
| 9) F | $C_{10}$—$C_{14}$—$C_{16}$ | 11.02 | 429,000 | 40 | 0.31 | | <−41 | 15,100 | 0 | 14,700 | 0 | −33.5 | −32.1 |
| 10) E | $C_{10}$—$C_{14}$—$C_{16}$ | 11.02 | 820,000 | 40 | 0.15 | 10.783 | <−41 | 12,500 | 0 | 15,200 | 0 | | |
| 11) AK | $C_{10}$—$C_{14}$—$C_{16}$ | 11.79 | 410,100 | 30 | 0.15 | | −33 | | | 21,700 | 0 | | |
| 12) AK | $C_{10}$—$C_{14}$—$C_{16}$ | 11.82 | 410,100 | 30 | 0.05 | | −36 | | | 22,600 | 0 | | |
| 13) AK | $C_{10}$—$C_{14}$—$C_{16}$ | 11.82 | 410,100 | 30 | 0.11 | 10.500 | −39 | 17,400 | 0 | 20,000 | 0 | | |
| 14) L | $C_{10}$—$C_{14}$—$C_{16}$ | 12.04 | 133,800 | 40 | 0.15 | 10.474 | −36 | 15,500 | 0 | 20,500 | 0 | | |
| 15) AR | $C_{12}$—$C_{14}$—$C_{16}$ | 12.03 | 259,900 | 40 | 0.15 | 11.092 | −39 | | | 25,800 | 0 | | |
| 16) D | $C_{12}$—$C_{14}$—$C_{16}$ | 12.04 | 219,000 | 40 | 0.15 | | −39 | 15,800 | 0 | 18,200 | 0 | | |
| 17) AT | $C_{12}$—$C_{14}$—$C_{18}$ | 11.7 | 219,000 | 30 | 0.15 | | −33 | | | 26,900 | 0 | | |
| 18) AW | $C_{12}$—$C_{14}$—$C_{18}$ | 12.36 | 415,000 | 20 | 0.15 | 11.014 | −36 | | | 16,900 | 0 | | |
| 19) N | $C_{12}$—$C_{14}$—$C_{18}$ | 12.36 | 415,000 | 40 | 0.15 | | −33 | 15,400 | 0 | 18,900 | 0 | | |
| 20) AZ | $C_{12}$—$C_{14}$—$C_{18}$ | 12.36 | 850,000 | 20 | 0.15 | 11.136 | −36 | | | 17,800 | 0 | | |
| 21) DDD | $C_{12}$—$C_{16}$—$C_{18}$ | 11.91 | 208,000 | 30 | 0.05 | | −36 | | | 30,500 | 0 | | |
| 22) DDD | $C_{12}$—$C_{16}$—$C_{18}$ | 11.91 | 208,000 | 30 | 0.11 | 10.437 | −33 | 16,100 | 0 | 29,000 | 0 | | |
| 23) J | $C_{12}$—$C_{16}$—$C_{18}$ | 11.91 | 208,000 | 40 | 0.15 | | −36 | 14,300 | 0 | 21,700 | 0 | | |

EXAMPLE 5

In this example, olefin copolymers were tested in 10W-40 Atlas 100N/325N blends. The results of these tests are given in Table 6 below. As can be seen from Table 6, the olefin copolymers with a Cav around 10 produced formulations with TP−1 problems, entries 1 and 2. However, the $C_{10}$-$C_{14}$-$C_{16}$ olefin copolymers with a Cav around 11 were very effective at a rate of 0.2 wt%, entry 6.

TABLE 6

OCP PPD PERFORMANCE IN 10W40s WITH ATLAS 100N/325N, VII A, AND DI D

| PPD | CAV | CAVM | CHAINS | WT. % | S.P. | MRV | Y.S. | TP-1 | 40K | 30K |
|---|---|---|---|---|---|---|---|---|---|---|
| 1) B | 10.03 | 10.08 | $C_{10}$—$C_{12}$—$C_{14}$ | 0.10 | | Solid | | Solid | | |
| 2) A | 10.06 | 9.77 | $C_{10}$—$C_{14}$—$C_{16}$ | 0.10 | | Solid | | Solid | | |
| 3) C | 11.01 | | $C_{10}$—$C_{12}$—$C_{14}$—$C_{16}$ | 0.10 | −24 | 19,400 | 0 | 16,900 | | |
| 4) F | 11.02 | | $C_{10}$—$C_{14}$—$C_{16}$ | 0.10 | −24 | 15,800 | 0 | 16,600 | | |
| 5) F | 11.02 | | $C_{10}$—$C_{14}$—$C_{16}$ | 0.10 | −24 | 14,000 | 0 | 16,500 | −30.1 | −28.6 |
| 6) F | 11.02 | | $C_{10}$—$C_{14}$—$C_{16}$ | 0.20 | −36 | 13,300 | 0 | 14,000 | | |
| 7) L | 12.04 | 11.84 | $C_{10}$—$C_{14}$—$C_{16}$ | 0.10 | −24 | 41,800 | 70 | 24,600 | | |
| 8) N | 12.36 | | $C_{12}$—$C_{14}$—$C_{18}$ | 0.10 | −27 | 28,000 | 0 | 25,800 | | |
| 9) O | 12.36 | | $C_{12}$—$C_{14}$—$C_{18}$ | 0.10 | −30 | 22,900 | 0 | 21,500 | | |

EXAMPLE 6

In this Example the olefin copolymers were tested in Atlas 100N 10W-40 blends. The results of these tests are given in Table 7 below. The $C_{10}$-$C_{14}$-$C_{16}$ olefin copolymer required a treatment rate of 0.3 wt% to produce a stable pour point of −33° C., entry 2. A molecular weight effect was observed whereby at a Mw of 180,000, the stable pour point was −15° C., entry 3. At a Mw of 400,000 the stable pour point was −33° C., entry 2. The treat rates were essentially identical, 0.30 wt% for Copolymer F and 0.31 wt% for Copolymer D.

TABLE 7

OCP PPD RESULTS IN 10W40 ATLAS 100N BLENDS WITH VII A, DI E, AND ATLAS 325N

| PPD | CAV | CAVM | CHAINS | WT. % | S.P. | MRV | Y.S. | TP-1 | Y.S. |
|---|---|---|---|---|---|---|---|---|---|
| 1) D | 11.02 | 10.93 | $C_{10}$—$C_{14}$—$C_{16}$ | 0.15 | −15 | 12,800 | 0 | 12,900 | 0 |
| 2) F | 11.02 | | $C_{10}$—$C_{14}$—$C_{16}$ | 0.30 | −33 | 13,900 | 0 | 13,100 | 0 |
| 3) D | 11.02 | 10.93 | $C_{10}$—$C_{14}$—$C_{16}$ | 0.31 | −15 | 12,000 | 0 | 12,900 | 0 |
| 4) J | 11.91 | 11.70 | $C_{12}$—$C_{16}$—$C_{18}$ | 0.30 | −33 | 14,200 | 0 | 14,300 | 0 |
| 5) K | 12.02 | | $C_{10}$—$C_{12}$—$C_{14}$—$C_{16}$—$C_{18}$ | 0.30 | −30 | 17,000 | 0 | 16,500 | 0 |

EXAMPLE 7

In this Example the olefin copolymers were tested in Atlas 100N 15W-40 Supreme Duty blends. The results of these tests are given in Table 8 below. As observed, the $C_{10}$-$C_{14}$-$C_{16}$ olefin gave very good results, although a molecular weight effect was observed in the stable pour results. The stable pour increased from −39° C., entry 4, to −15° C., entry 3, when the Mw was decreased from 400,000 to 180,000, respectively.

TABLE 8

OCP PPD RESULTS IN 15W40 SD BLENDS WITH TLA 7200A, DI F, ATLAS 325N, BRIGHT STOCK, OR ATLAS 100N

| Tests | PPD | Wt. % | CAV | Chains | S.P. | MRV | TP-1 | Sc. Brookfield 40K | Sc. Brookfield 30K |
|---|---|---|---|---|---|---|---|---|---|
| 1) F | 0.25 | 11.02 | | $C_{10}$—$C_{14}$—$C_{16}$ | <−41 | 10,450 | 11,500 | −27.2 | −25.5 |
| 2) F | 0.21 | 11.02 | | $C_{10}$—$C_{14}$—$C_{16}$ | | 11,500 | 11,600 | | |
| 3) D | 0.21 | 11.02 | 10.93 | $C_{10}$—$C_{14}$—$C_{16}$ | −15 | 11,300 | 12,800 | | |
| 4) F | 0.25 | 11.02 | | $C_{10}$—$C_{14}$—$C_{16}$ | −39 | 11,100 | 11,700 | −25.8 | −24.7 |
| 5) J | 0.21 | 11.91 | 11.70 | $C_{12}$—$C_{16}$—$C_{18}$ | | 12,100 | 11,800 | | |
| 6) J | 0.25 | 11.91 | 11.70 | $C_{12}$—$C_{16}$—$C_{18}$ | −33 | 11,200 | 11,900 | | |
| 7) K | 0.21 | 12.02 | | $C_{10}$—$C_{12}$—$C_{14}$—$C_{16}$—$C_{18}$ | | 11,700 | 12,100 | | |
| 8) K | 0.21 | 12.02 | | $C_{10}$—$C_{12}$—$C_{14}$—$C_{16}$—$C_{18}$ | | 11,200 | 12,100 | | |

EXAMPLE 8

OCP PPDs composed of $C_{10}$-$C_{14}$-$C_{16}$, D and F, were succesfully tested in 10W30s, 10W40s and 15W40s blended with Ashland base stocks. These results are shown in Table 9. VII B and DI F were used in these blends. The excellent low temperature properties clearly illustrate the OCP PPD was not optimized for one class of base stock. The versatility of these OCP PPDs enhances their value.

TABLE 9

OCP PPD RESULTS IN ASHLAND BASE STOCKS WITH VII B AND DI G

| Grade | PPD | Wt. Average | Wt. PPD | KIN VIS | Stable Pour | TPI | YST | 40K | 30K |
|---|---|---|---|---|---|---|---|---|---|
| 10W30 | F | 429,000 | 0.20 | 11.047 | −45 | 10,700 | 0 | −32.5 | −30.8 |
| 10W30 | D | 186,000 | 0.20 | 10.835 | −45 | 10,300 | 0 | −33.0 | −31.3 |
| 10W40 | F | 429,000 | 0.20 | 14.727 | −39 | 14,500 | 0 | −30.7 | −28.9 |
| 10W40 | D | 186,000 | 0.20 | 14.614 | −45 | 14,600 | 0 | −31.0 | −29.2 |
| 15W40 SD | F | 429,000 | 0.25 | 15.622 | −36 | 10,500 | 0 | −27.8 | −26.0 |
| 15W40 SD | D | 186,000 | 0.25 | 15.402 | −45 | 10,200 | 0 | −28.0 | −26.3 |

From the above examples, it can be appreciated that the olefin copolymers of the present invention are capable of functioning as pour point depressants.

We claim:

1. A pour point depressant for lubricating oils comprising an olefin terpolymer which contains alkyl side chains wherein the average alkyl side chain length in the terpolymer is 10.5 to 12.0, said olefin terpolymer being prepared by the polymerization of three monomers selected from the group consisting of $C_{10}$, $c_{14}$ and $C_{16}$ olefin hydrocarbons, wherein each monomer is presen in the polymerization in an amount of at least 10 wt.%.

2. A pour point depressant for lubricating oils according to claim 1, wherein the molecular weight of said copolymer is from 150,000 to 540,000.

3. A lubricating oil composition comprising a wax-containing hydrocarbon lubricating oil, said lubricating oil containing a sufficient amount of a pour point depressant to reduce the Federal Stable pour point to −35° C., said pour point depressant comprising a pour point depressant effective amount of an lefin terpolymer which contains alkyl side chains wherein the average alkyl side chain length in the terpolymer is 10.5 to 12.0, and wherein said olefin terpolymer is prepared by the polymerization of three monomers selected from the group consisting of $C_{10}$, $C_{14}$ and $C_{16}$ olefin hydrocarbons, and wherein each monomer is present in the polymerization in an amount of at lest about 10 wt.%.

4. A lubricating oil composition according to claim 3, wherein the molecular weight of said terpolymer is from 150,000 to 540,000.

5. A method of depressing the pour point of a lubricating oil composition which comprises adding to the lubricating oil composition a pour point depressing amoutn of a pour point depressant to reduce the pour point of said oil composition, said pour point depressant comprising an olefin terpolymer which contains alkyl side chains wherein the average alkyl side chain length in the terpolymer is 10.5 to 12.0 nd wherein said olefin terpolymer is prepared by the polymerization of three monomers selected from the group consisting of $C_{10}$, $C_{14}$ and $C_{16}$ olefin hydrocarbons, and wherein each monomer is present in the polymerization in an amount of at least about 10 wt.%.

6. A method of depressing the pour point of a lubricating oil composition according to claim 5, wherein the molecular weight of said copolymer is from 150,000 to 540,000.

7. A method according to claim 5 wherein the pour point depressant is present in an mount of about 0.001 to 1.0 wt% of the lubricating oil.

* * * * *